US008202023B2

(12) United States Patent
Millheim

(10) Patent No.: US 8,202,023 B2
(45) Date of Patent: Jun. 19, 2012

(54) SELF-STANDING RISER AND BUOYANCY DEVICE DEPLOYMENT AND POSITIONING SYSTEM

(76) Inventor: Keith K. Millheim, The Woodlands, TX (US)

( * ) Notice: Subject to any disclaimer, the term of this patent is extended or adjusted under 35 U.S.C. 154(b) by 0 days.

(21) Appl. No.: 13/028,632

(22) Filed: Feb. 16, 2011

(65) Prior Publication Data

US 2011/0135396 A1 Jun. 9, 2011

Related U.S. Application Data

(63) Continuation of application No. 12/724,563, filed on Mar. 16, 2010, now abandoned, which is a continuation of application No. 12/274,814, filed on Nov. 20, 2008, now abandoned.

(60) Provisional application No. 61/003,748, filed on Nov. 20, 2007.

(51) Int. Cl.
*F16L 1/15* (2006.01)

(52) U.S. Cl. ..... 405/166; 405/169; 405/158

(58) Field of Classification Search ..... 405/166, 405/169, 171, 223.1, 224, 224.2; 166/350, 166/367

See application file for complete search history.

(56) References Cited

U.S. PATENT DOCUMENTS

| | | | | |
|---|---|---|---|---|
| 3,369,599 | A * | 2/1968 | Evans | 166/350 |
| 3,999,617 | A * | 12/1976 | Ilfrey et al. | 166/350 |
| 4,486,123 | A * | 12/1984 | Koch et al. | 405/169 |
| 4,617,998 | A * | 10/1986 | Langner | 166/345 |
| 4,730,677 | A * | 3/1988 | Pearce et al. | 405/224.2 |
| 5,330,294 | A * | 7/1994 | Guesnon | 405/224.2 |
| 5,342,148 | A * | 8/1994 | Huete et al. | 405/223.1 |
| 5,380,229 | A * | 1/1995 | Korsgaard | 441/3 |
| 6,085,851 | A * | 7/2000 | Scott et al. | 405/195.1 |
| 6,276,456 | B1 * | 8/2001 | Head | 405/224.2 |
| 6,336,419 | B1 * | 1/2002 | Breivik | 114/248 |
| 6,837,311 | B1 * | 1/2005 | Sele et al. | 405/224.4 |
| 2005/0063788 | A1 * | 3/2005 | Clausen | 405/224.2 |
| 2006/0140726 | A1 * | 6/2006 | Pollack et al. | 405/224.2 |
| 2007/0193496 | A1 * | 8/2007 | Sebellin | 114/65 R |
| 2008/0128138 | A1 * | 6/2008 | Radi | 166/350 |
| 2009/0126617 | A1 * | 5/2009 | Millheim | 405/224.2 |
| 2009/0151955 | A1 * | 6/2009 | Bamford et al. | 166/243 |

* cited by examiner

*Primary Examiner* — Frederick L Lagman
(74) *Attorney, Agent, or Firm* — Raymond R. Ferrera; Adams and Reese LLP

(57) ABSTRACT

A water-borne vessel for deploying a self-standing riser system is provided, wherein the vessel hull is configured to receive, transfer and deploy components of a self-standing riser system. The vessel hull includes at least a landing platform, a component transfer means, and a deployment platform suitable for deploying the riser components into associated surrounding waters. Various means of assisting the process whereby self-standing riser components are loaded onto the vessel and stored; transferred from receiving to deployment platforms; and deployed from the vessel into surrounding waters are also considered.

9 Claims, 6 Drawing Sheets

SELF-STANDING RISER AND BUOYANCY DEVICE DEPLOYMENT AND POSITIONING SYSTEM

CROSS REFERENCE TO RELATED APPLICATIONS

The present application is a continuation of U.S. Non-Provisional Application No. 12/ 724,563 filed Mar. 16, 2010, now abandoned, which is a continuation of U.S. Non-Provisional Application No. 12/274,814 filed Nov. 20, 2008, now abandoned, which claims the benefit of prior U.S. Provisional Application No. 61/003,748, filed Nov. 20, 2007.

FIELD OF THE INVENTION

The present invention relates generally to self-standing riser systems used during energy exploration and production, and in a particular though non-limiting embodiment, to a system useful for deploying self-standing risers and associated buoyancy devices in a variety of operating conditions.

BACKGROUND OF THE INVENTION

Over the past decade, there has been an increasing worldwide demand for oil and gas production. At present, however, oil and gas supply continues to lag far behind demand, a situation which has at times contributed significantly to worldwide economic difficulties and could well present a major concern for many years to come.

In an effort to balance supply and demand, companies and governmental entities have begun to explore and develop relatively marginal fields in the deeper offshore waters of the Gulf of Mexico, West Africa and Brazil. However, due to high construction costs and limited manufacturing facilities, only a small number of mobile offshore drilling units (MODUs) are being manufactured each year, thereby resulting in escalating "per day" unit costs and a shortage of associated offshore drilling, completion and workover equipment.

Moreover, even though the cost differential between drilling operations and completion or workover operations is relatively modest (since MODUs usually perform all of these functions during a typical operation), most such projects are still inefficient, because a MODU actively performing one function (e.g., drilling) is generally not able to accomplish any other functions (e.g., completion or workover).

In other applications by this inventor, it has been shown that a self-standing riser system can be safely and reliably installed in communication with a well head or production tree. Such risers by design are self-supporting, and provide all of the necessary risers, casing, buoyancy chambers, etc., required for exploration and production and of oil, gas and other hydrocarbons. Self-standing risers also provide the requisite safety features required to ensure that the produced hydrocarbons do not escape from the system out into surrounding waters. For example, self-standing riser systems fully support both surface-based and semi-submersible platform interfaces, blow-out preventers, production trees, and other common exploration and production installations.

Known self-standing riser systems require either a number of different surface vessels or a MODU for installation, due to the size and weight of riser stacks, drilling pipe, buoyancy devices, etc. For many installations, expensive hull and deck modifications also have to be made. Accordingly, few improvements in associated per-day costs have been realized.

There is, therefore, a need for a more cost-effective method of installing self-standing riser systems, which does not require the use of MODUs.

SUMMARY OF THE INVENTION

A water-borne vessel for deploying a self-standing riser system is provided, wherein the vessel hull is configured to receive, transfer and deploy components of a self-standing riser system. The vessel hull includes at least a landing platform, a component transfer means, and a deployment platform suitable for deploying the riser components into associated surrounding waters. Various means of assisting the process whereby self-standing riser components are loaded onto the vessel and stored; transferred from receiving to deployment platforms; and deployed from the vessel into surrounding waters are also considered.

DETAILED DESCRIPTION

The description that follows includes exemplary systems, methods, and techniques that embody various aspects of the presently inventive subject matter. However, it will be readily understood by those of skill in the pertinent arts that the described embodiments may be practiced without one or more of these specific details.

In other instances, well-known manufacturing equipment, protocols, structures and techniques have not been shown in detail in order to avoid obfuscation in the description.

Figure 1B:
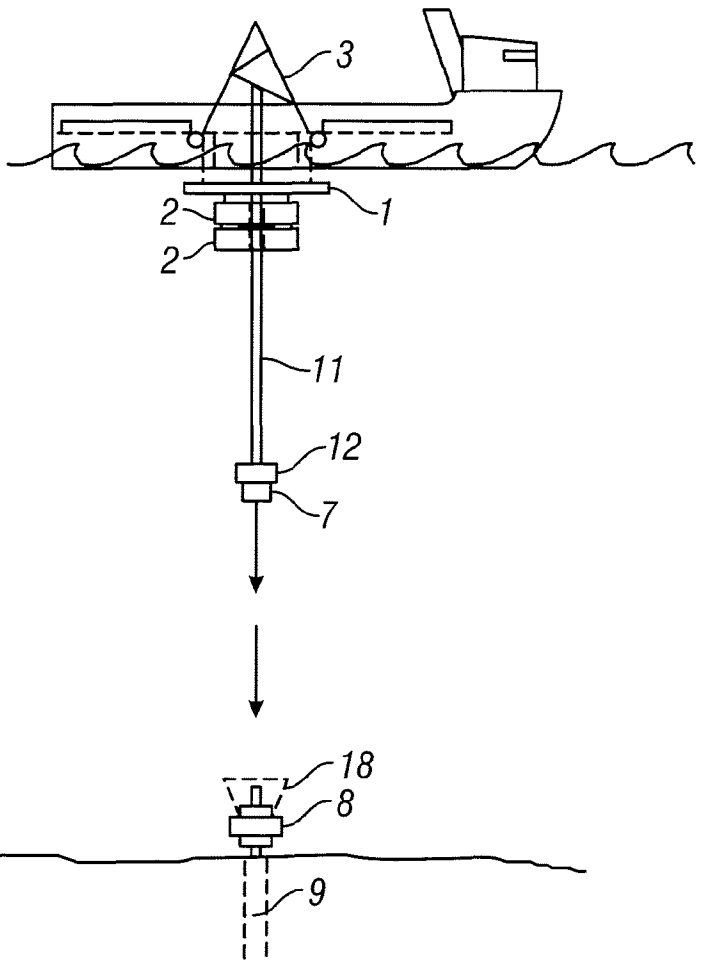
FIG. 1B is a schematic diagram depicting the submersion of a self-standing riser system, according to example embodiments.
Figure 1A:
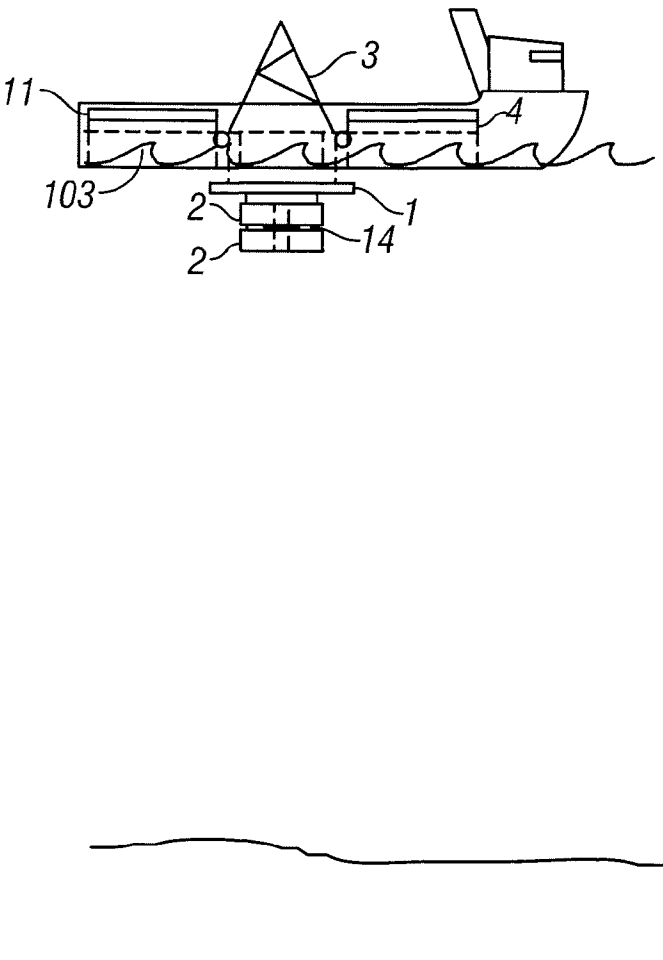
FIG. 1A is a side view of a self-standing riser deployment vessel, according to example embodiments.

Referring now to FIG. 1A, an example embodiment of a self-standing riser deployment vessel 6 is depicted, comprising a plurality of buoyancy devices 2 temporarily attached to the bottom of the hull. In exemplary embodiments, deployment vessel 6 is a workboat, anchor handling boat, or any other available vessel of suitable size and configuration; the lengths of such vessels might range, for example, from around 150 ft. to around 300 ft., though these size estimates should not be deemed as limitative.

Other embodiments of deployment vessel 6 comprise enough deck and storage space to carry associated riser tubing 4, and additional buoyancy devices 2. Still further embodiments employ dynamic positioning equipment (e.g., a spar), which facilitate efficient and reliable riser stack deployment and installation on the sea floor.

In one embodiment, an entire string of risers is assembled with one or more buoyancy devices interspersed as needed in order to provide sufficient buoyancy for the entire system. The string is then deployed as a continuous structure and lowered to the sea floor in a controlled manner. The top of the string is then secured and lifted so that it can be moved over the drilling site and attached to the well. In other embodiments, the system is deployed in a piecemeal fashion, with sections of a desired length being individually deployed and mechanically joined as the assembly is completed.

In the example embodiment illustrated in FIG. 1A, deployment vessel 6 further comprises a hoisting frame 3 disposed near a moon pool. The hoisting frame permits riser 4 stored within the vessel to be loaded and lowered or held in position. In various embodiments, the lowering, raising and holding of riser 4 is facilitated using conveyor belts, chains, rollers, etc. In one example embodiment, riser 4 is transferred from a storage container towards the moon pool using a conveyor belt, and subsequently connected to a fastening device affixed to hoisting frame 3. The riser can then be deployed or held in a desired position in a safe and reliable manner.

Consistent with the example deployment vessel 6 illustrated in FIG. 1A, further embodiments also comprise loading mechanisms (e.g., frames, rails, etc.) used to load, guide and control the buoyancy devices 2. FIG. 1A, for example, depicts two buoyancy devices 2 disposed in mechanical communication with the bottom of the hull of the deployment vessel 6. The buoyancy devices 2 are affixed to a carrying frame 1 configured to reliably accommodate large, heavy loads. Carrying frame requirements will vary by project, but each such device should, at minimum, be capable of supporting the weight of one or more buoyancy devices. Electric, hydraulic or pneumatic lifts can be used to raise and lower the buoyancy devices, and ropes, chains, and tension lines reeled out from strategically placed winches can assist in the fine control necessary to ensure safe and controlled deployment of the buoyancy devices.

In some embodiments, each of said buoyancy devices 2 further comprises a connector 14 (i.e., a flange or receptive housing, etc.) that allows for attachment of additional buoyancy devices 2 or riser assemblies 4.

In the example embodiment depicted in FIG. 1B, each of the buoyancy devices further admit to the passing of riser 4 through a void space in the buoyancy devices by means of a hoisting frame 3, so that the riser 4 can subsequently be attached to a subsurface wellhead 8 installed atop a well bore 9. A flanged member 18 can be used to help capture descending riser and assist in connection of the riser to the wellhead.

Figure 1D:
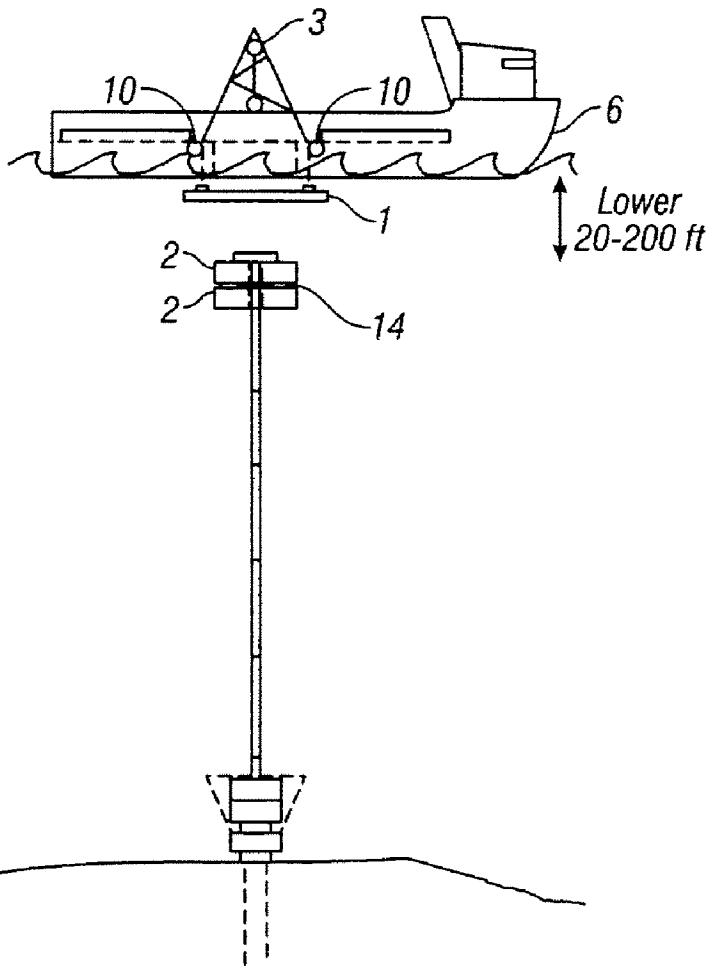
FIG. 1D is a schematic diagram of a deployment vessel releasing from a completed self-standing riser system, according to example embodiments
Figure 1C:
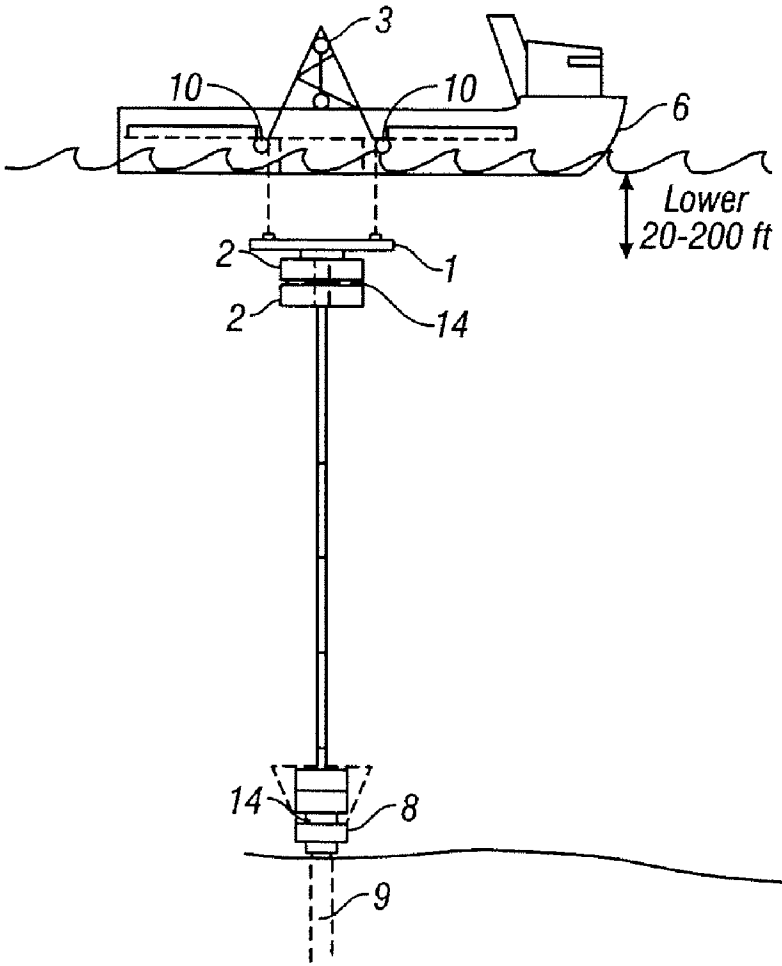
FIG. 1C is a schematic diagram of a deployment vessel positioning a completed self-standing riser system, according to example embodiments.

In the example embodiment illustrated in FIG. 1C, deployment vessel 6 is used to lower a fully assembled self-standing riser system into position for attachment with wellhead 8. Guide frame 1 assists in the controlled deployment of the riser near the surface, and a flanged member 14 assists in capture of the lowered riser. In other embodiments, deployment vessel 6 utilizes dynamic positioning equipment (or alternatively, light equipment such as ropes, chains, winch lines, etc.) to lower, raise and support the riser stack as it is position above the wellhead. Further embodiments utilize buoyancy devices to tension the stack as deployment is carried out, and to dynamically position the riser between the vessel and the well.

As seen in FIG. 1D, once the self-standing riser system is deployed and attached to the well, the surface vessel releases its hold and the vessel can be used for other operations on a cost-effective basis. In some embodiments, the vessel deploys the self-standing riser and leaves the site so that other vessels (e.g., vessels with testing packages, separators, or even MODUs when one becomes available) can interface with the system and initiate completion, testing or workover operations.

Figure 2A:
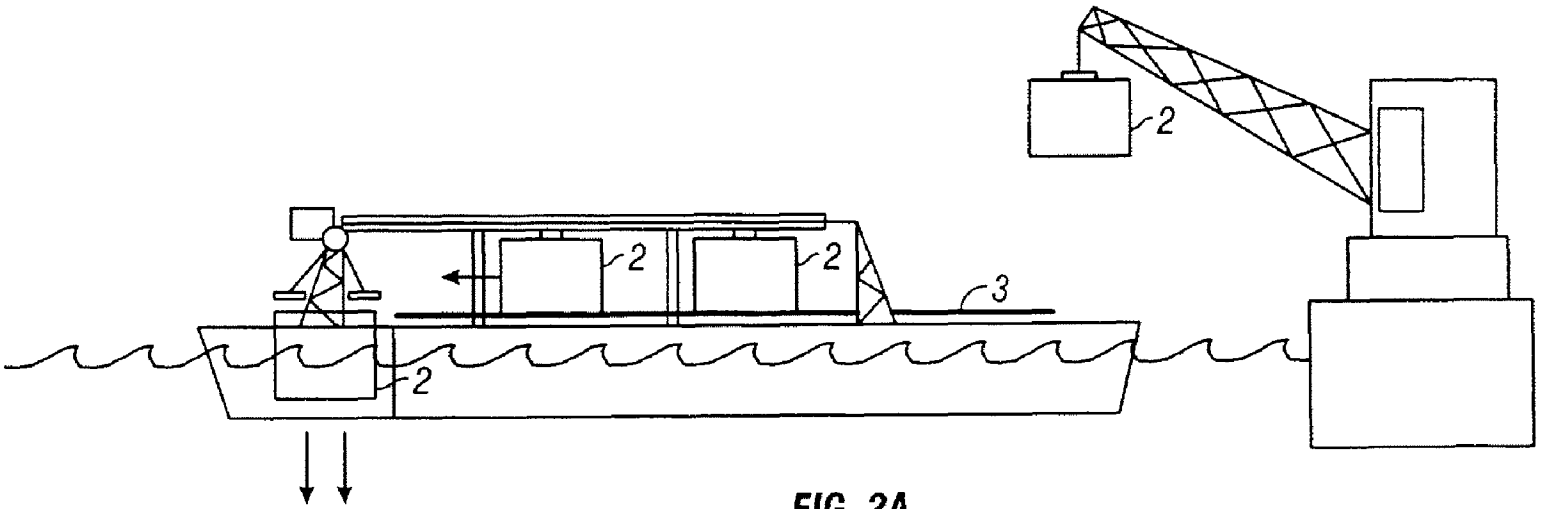
FIG. 2A is a side view of a self-standing riser system deployment vessel, according to example embodiments.

Referring now to FIG. 2A, a side view of a deployment vessel is illustrated, comprising a plurality of buoyancy devices 2 and a reliable means for deployment thereof. Some embodiments comprise one or more of a loading crane, a hoisting frame, buoyancy device transmission and positioning means 5, etc., disposed near a moon pool.

Figure 2B:
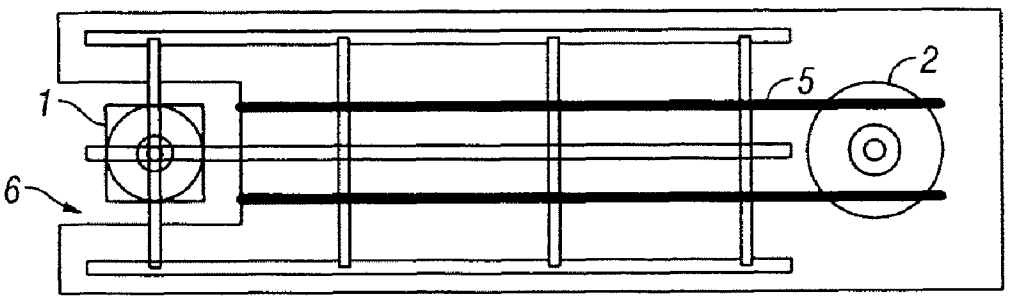
FIG. 2B is top view of a self-standing riser system vessel equipped with a buoyancy device loading bay, according to example embodiments.

As seen in FIG. 2B, it may be convenient that the moon pool is formed at the aft end of the vessel. In an especially novel approach, the aft end is open, and the moon pool has only three sides 6, so that greater flexibility in position is achieved. In still further embodiments, the buoyancy devices 2 are loaded onto the deployment vessel from a neighboring service vessel, whereafter operations are carried out as described above.

In the example embodiment depicted in FIG. 2A, a plurality of buoyancy devices 2 are loaded onto the deployment vessel from a neighboring vessel, positioned for deployment from the deployment vessel by a transmission means 5, and then deployed into a body of water in a safe and controlled fashion that ensures efficient operations and maintenance of the buoyancy devices' structural integrity.

In some embodiments, a neighboring crane is used to lower the buoyancy devices onto a deployment vessel landing platform, as depicted in FIG. 2A. The landing platform can be either flooded (in the event the devices are intended for immediate deployment), or dry (in the deployment is intended for a later time, or if access is needed so as to permit outfitting or maintenance). If the landing platform is dry, intake ports are provided so that it can later be flooded, allowing easier transportation and deployment of the devices at or near the drilling site (see, for example, FIG. 2C). Such embodiments would likely utilize winches, fastening mechanisms, etc., to secure and facilitate safe and reliable control of the devices. The deployment vessel can then transport and deploy the devices as described above.

Figure 2C:
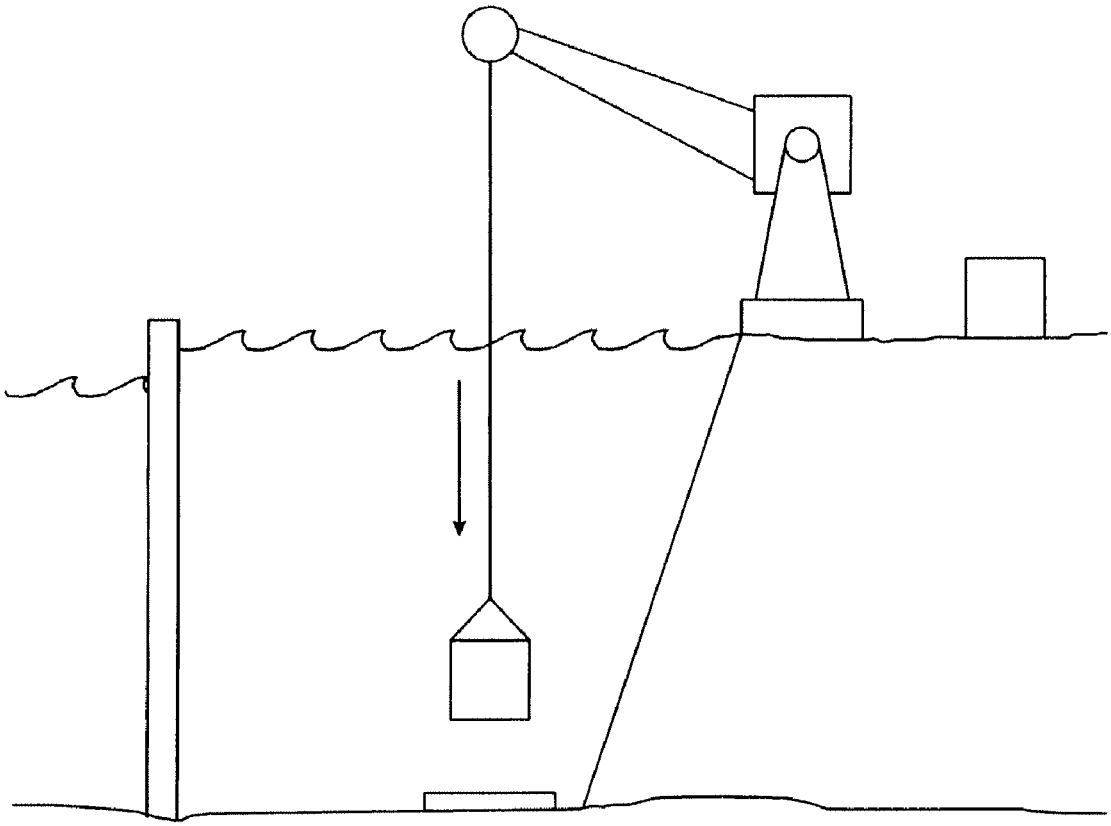
FIG. 2C is a schematic diagram depicting a buoyancy device being lowered into a buoyancy device loading bay, according to example embodiments.

In the example embodiment depicted in FIG. 2C, a barge or other transport vessel is used to transfer additional buoyancy devices to the landing platform of a deployment vessel by means of a rope, chain, winch line, etc. In one particular embodiment, the buoyancy devices are moved via roller tracks toward an overhead gantry, hoisted by a crane or other hoisting device, and lowered into the deployment pool.

Figure 2D:
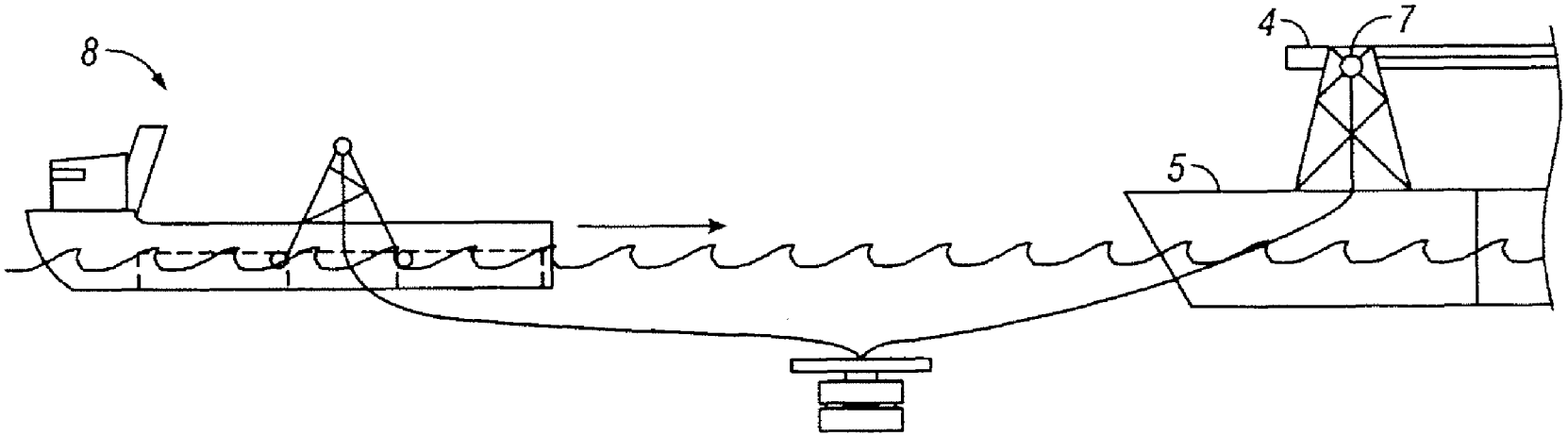
FIG. 2D is a schematic diagram of a deployment vessel beginning its release of a deployed buoyancy device stack, according to example embodiments.
Figure 2E:
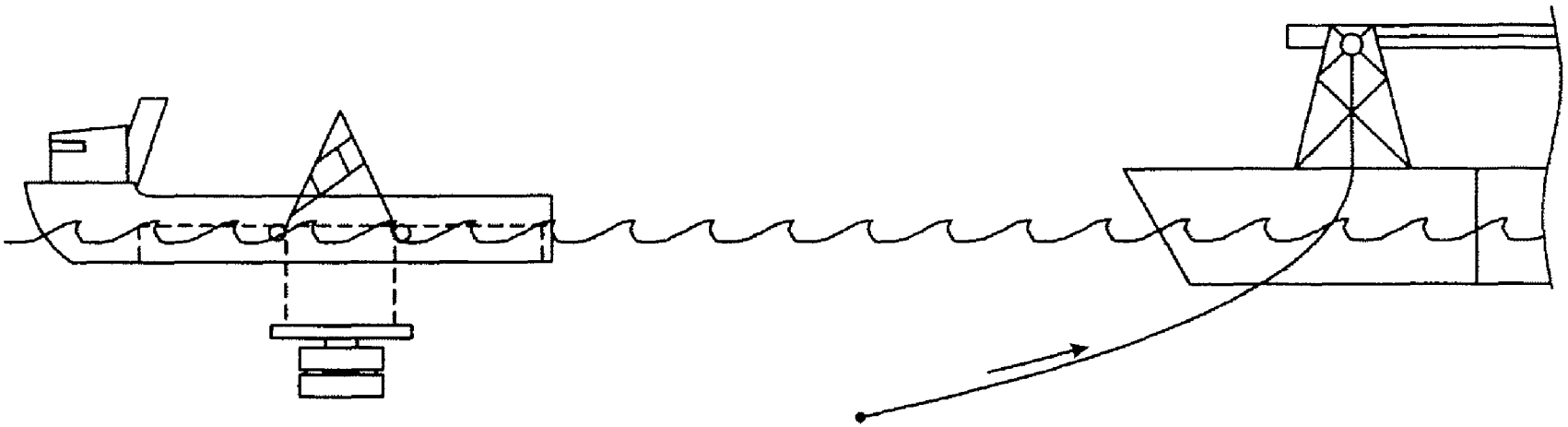
FIG. 2E is a schematic of a deployment vessel having released its load, and leaving the site prior to commencement of drilling operations.

In the example embodiment depicted in FIG. 2D, the buoyancy devices have been landed from a service vessel and lowered into the water. The devices are then towed in by a second deployment vessel and attached to its hull via winches, hooks, fastening mechanisms, etc., disposed in mechanical communication with the second deployment vessel. In FIG. 2E, the second deployment vessel has captured and secured the devices, and the service vessel has released its line. The service vessel can then repeat the process until the desired number of buoyancy devices has been transferred to a desired number of deployment vessels.

The foregoing specification is provided for illustrative purposes only, and is not intended to describe all possible aspects of the present invention. Moreover, while the invention has been shown and described in detail with respect to several exemplary embodiments, those of ordinary skill in the art will appreciate that minor changes to the description, and various other modifications, omissions and additions may also be made without departing from the spirit or scope thereof.

The invention claimed is:

1. A water-borne vessel for deploying a self-standing riser system, said vessel comprising: a vessel hull configured to receive, transfer and deploy components of a self-standing riser system, wherein said vessel hull further comprises a landing platform, a transfer means, and a deployment platform, wherein said deployment platform further comprises a movable, submersible deployment means for deploying self-standing riser components from said deployment platform into associated surrounding waters.

2. The water-borne vessel for deploying a self-standing riser system of claim 1, wherein said landing platform further comprises a hoisting means.

3. The water-borne vessel for deploying a self-standing riser system of claim 1, wherein said landing platform further comprises an intake port for flooding said receiving platform.

4. The water-borne vessel for deploying a self-standing riser system of claim 1, wherein said transfer means further comprises means for transferring self-standing riser components from said receiving platform to said deployment platform.

5. The water-borne vessel for deploying a self-standing riser system of claim 4, wherein said transferring means further comprises a securing means for securing said components during transfer from said receiving platform to said deploying platform.

6. The water-borne vessel for deploying a self-standing riser system of claim 1, wherein said deployment platform further comprises a receiving means for receiving self -standing riser components transferred from said receiving platform.

7. The water-borne vessel for deploying a self-standing riser system of claim 1, wherein said deployment platform further comprises a securing means for securing self-standing riser components received from said transferring means.

8. The water-borne vessel for deploying a self-standing riser system of claim 1, wherein said deployment platform further comprises a hoisting means for hoisting self-standing riser components received from said transferring means into a deployment position.

9. The water-borne vessel for deploying a self-standing riser system of claim 1, wherein said water-borne vessel further comprises a storage area for storing self-standing riser components placed upon said vessel.

* * * * *